US006951580B1

(12) United States Patent
Ludwicki

(10) Patent No.: US 6,951,580 B1
(45) Date of Patent: Oct. 4, 2005

(54) METHOD FOR MINIMIZING BOWING OF COLLECTOR PLATES IN AN ELECTROSTATIC PRECIPITATOR, AND A COLLECTOR PLATE-CLIP COMBINATION

(75) Inventor: Gregory Ludwicki, Valparaiso, IN (US)

(73) Assignee: NiSource Corporate Services Company, Wheatfield, IN (US)

( * ) Notice: Subject to any disclaimer, the term of this patent is extended or adjusted under 35 U.S.C. 154(b) by 0 days.

(21) Appl. No.: 10/823,205

(22) Filed: Apr. 13, 2004

(51) Int. Cl.[7] ..... B03C 3/40; B03C 3/76; B03C 3/86

(52) U.S. Cl. ..... 95/57; 52/713; 95/74; 95/76; 96/15; 96/32; 96/83; 96/84; 96/86; 96/87; 96/89; 96/90; 96/98; 96/100

(58) Field of Search ..... 96/15, 32, 51, 96/83–90, 98, 100; 95/57, 74–76; 52/713; 248/592, 599

(56) References Cited

U.S. PATENT DOCUMENTS

| | | | | | |
|---|---|---|---|---|---|
| 2,542,262 | A | * | 2/1951 | Richardson | 96/86 |
| 2,866,517 | A | | 12/1958 | Phyl | 96/91 |
| 3,277,622 | A | | 10/1966 | Jensen | 52/222 |
| 3,300,850 | A | | 1/1967 | Steuernagel | 29/432.1 |
| 3,373,487 | A | * | 3/1968 | Quintilian | 29/884 |
| 3,643,391 | A | | 2/1972 | Mollinger | 52/83 |
| 3,803,809 | A | | 4/1974 | Gehaar et al | 96/93 |
| 3,892,545 | A | | 7/1975 | Goransson | 96/35 |
| 3,997,304 | A | * | 12/1976 | Carr | 96/67 |
| 4,007,023 | A | | 2/1977 | Batza et al. | 96/33 |
| 4,035,886 | A | | 7/1977 | Glück | 445/67 |
| 4,047,353 | A | | 9/1977 | Aarons | 52/713 |
| 4,047,907 | A | | 9/1977 | Knutsson et al. | 96/89 |
| 4,118,836 | A | | 10/1978 | Duboc et al. | 204/279 |
| 4,166,729 | A | | 9/1979 | Thompson et al. | 96/79 |
| 4,239,514 | A | * | 12/1980 | Junkers | 96/87 |
| 4,240,810 | A | * | 12/1980 | Frauenfelder | 96/86 |
| 4,294,591 | A | | 10/1981 | Kahl | 96/43 |
| 4,325,714 | A | | 4/1982 | Wooldridge | 96/86 |
| 4,516,992 | A | | 5/1985 | Jonelis | 96/87 |
| 4,519,818 | A | | 5/1985 | Jonelis | 96/72 |
| 4,559,064 | A | * | 12/1985 | Ahern | 96/87 |
| 4,647,296 | A | * | 3/1987 | Tuck | 96/87 |
| 4,666,475 | A | | 5/1987 | Gustavsson | 96/92 |
| 4,673,417 | A | | 6/1987 | Göransson et al. | 96/92 |
| 4,710,203 | A | | 12/1987 | Bätza et al. | 95/57 |
| 4,722,743 | A | * | 2/1988 | Joy et al. | 96/87 |
| 4,747,856 | A | | 5/1988 | Hicks et al. | 96/86 |
| 4,759,779 | A | | 7/1988 | Shedd | 96/87 |
| 4,765,802 | A | | 8/1988 | Gombos et al. | 96/70 |
| 4,869,736 | A | | 9/1989 | Ivester et al. | 96/100 |
| 5,173,867 | A | | 12/1992 | Johnston et al. | 700/275 |
| 5,344,481 | A | | 9/1994 | Pettersson | 96/33 |
| 5,366,540 | A | * | 11/1994 | Bojsen | 96/33 |
| 5,391,222 | A | * | 2/1995 | Nelson et al. | 96/90 |

(Continued)

FOREIGN PATENT DOCUMENTS

| | | | | |
|---|---|---|---|---|
| GB | 2207620 | * | 2/1989 | 96/87 |

(Continued)

*Primary Examiner*—Richard L. Chiesa
(74) *Attorney, Agent, or Firm*—Schiff Hardin LLP

(57) ABSTRACT

A bow-reduced precipitator collector plate assembly and an appertaining method include a precipitator collector plate that contacts a spring-like stiffening element configured to be attached to a fixed anchor or an adjacent anchoring collector plate. The stiffening element is configured to apply a force in a direction normal to a primary plane, which is generally co-linear but opposite in direction of a direction of bowing, of the precipitator collecting plate.

16 Claims, 5 Drawing Sheets

U.S. PATENT DOCUMENTS

| | | | | | |
|---|---|---|---|---|---|
| 5,482,540 | A | | 1/1996 | Trinward et al. | 95/57 |
| 5,529,608 | A | | 6/1996 | Jonelis | 95/57 |
| 5,600,971 | A | * | 2/1997 | Suk | 52/713 |
| 5,665,147 | A | | 9/1997 | Taylor et al. | 96/72 |
| 5,725,638 | A | * | 3/1998 | Cross et al. | 96/71 |
| 5,931,989 | A | | 8/1999 | Knutsson | 96/33 |
| 5,966,893 | A | | 10/1999 | Quillin | 52/713 |
| 6,048,385 | A | * | 4/2000 | Koide | 96/83 |
| 6,156,104 | A | * | 12/2000 | Jeong | 96/88 |
| 6,187,271 | B1 | | 2/2001 | Lee et al. | 422/121 |
| 6,543,729 | B1 | * | 4/2003 | Ylonen | 248/48.1 |
| 6,658,796 | B1 | * | 12/2003 | Higgins | 52/11 |

FOREIGN PATENT DOCUMENTS

| | | | | |
|---|---|---|---|---|
| JP | 4-190861 | * | 7/1992 | 96/83 |

* cited by examiner

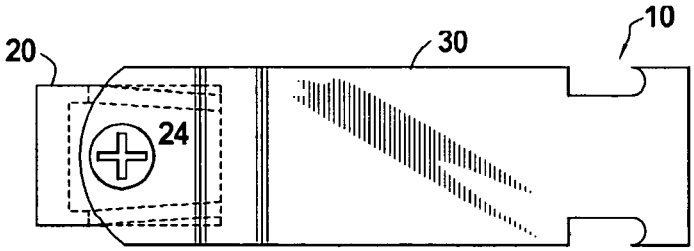
FIG. 1
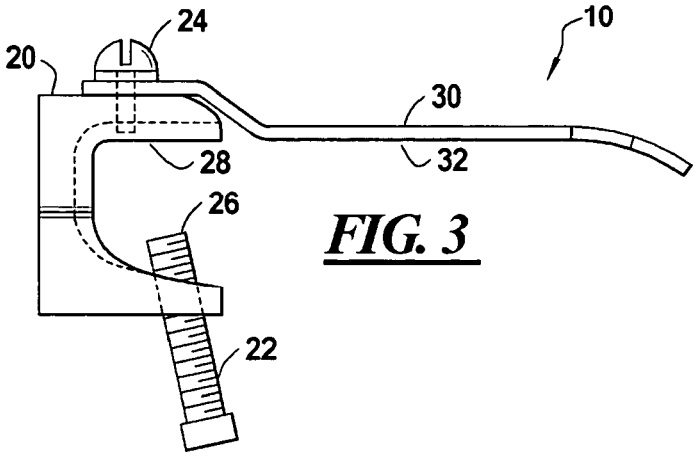
FIG. 3
FIG. 2
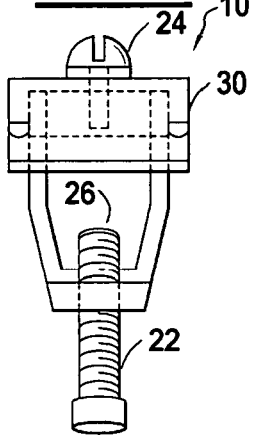
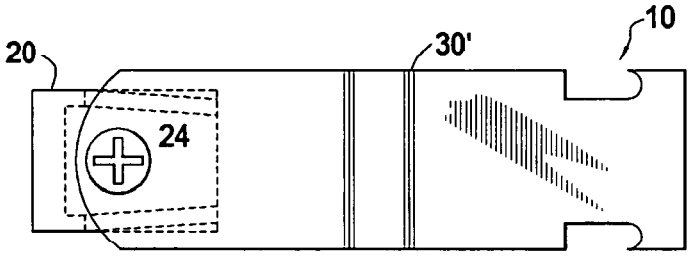
FIG. 4
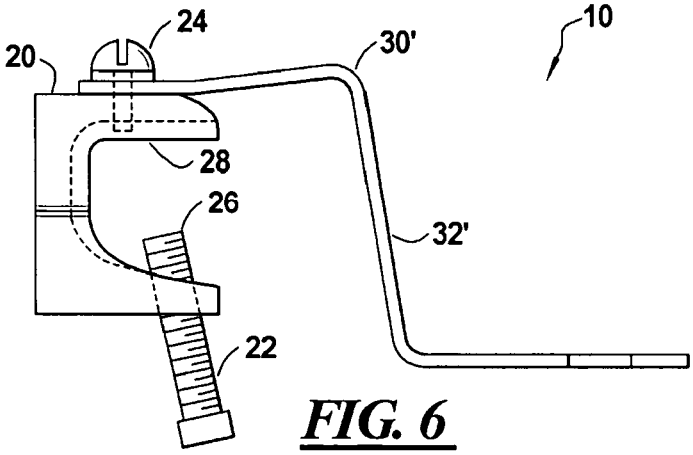
FIG. 6
FIG. 5
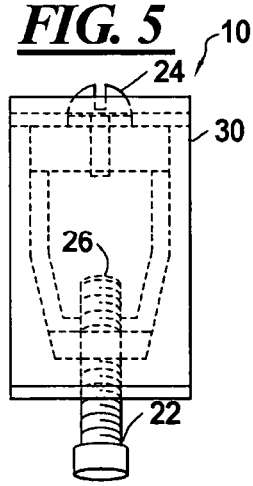

METHOD FOR MINIMIZING BOWING OF COLLECTOR PLATES IN AN ELECTROSTATIC PRECIPITATOR, AND A COLLECTOR PLATE-CLIP COMBINATION

BACKGROUND OF THE INVENTION

The invention is directed to a system and appertaining method for minimizing a bowing of collector plates in an electrostatic precipitator utilizing a clip configuration that permits movement of the collector plate.

In an electrostatic precipitator, discharge electrodes and collector plates are disposed in a flue in which particle-containing gases flow. The particles in the flowing gas are ionized by the discharge electrode, and migrate toward the collector plates as a result of electrostatic attraction, where they are held. Periodically, the collector plates are rapped to shake the accumulated particles from them to a collection bin for disposal. In order for the rapping to be effective in removing accumulated particles, the collector plates must have some degree of freedom for movement.

Over time, the collector plates, which have an extremely large surface area, become bowed or warped. Since the difference in potential between the discharge electrode and the collector plate is dependent on the spacing between them, bowing of the collector plates changes this distance and reduces the efficiency of the precipitator, and in extreme cases may result in arcing if the spacing becomes too small.

U.S. Pat. No. 4,516,992 addresses the problem of bowing or warping of the plate electrodes in a precipitator collecting plate 90 (FIG. 9, present application) by providing a connector 94 that is fixedly mounted to a bar 92 to one end of the collecting plate 90. The plate may be straightened by applying a torque moment to the elongated bar 92 to which the other end of the connector is attached.

FIG. 2 of the '992 patent illustrates the location of exemplary discharge wires 38 and a bowing that changes the distance of the plates to these wires.

The design of the '992 patent may work adequately when a limited symmetrical bow occurs in a precipitator plate, but does little to address complex forms of bowing in multiple dimensions or twisting deformations of the plates which is very common.

SUMMARY OF THE INVENTION

The present invention provides an inexpensive way to assist in the straightening of a collecting plate (or preventing bowing in the collecting plate), utilizing one or more clamps or clips, each having a stiffening element attached to it. The clamp is affixed at the edge of an collector plate or at an anchor point, and the stiffening element extends over a portion of the surface of the collector plate. The stiffening element provides a spring force that opposes the bowing or warping, and either straightens an already-bowed plate, or minimizes the bowing of a fresh plate.

The clamp itself may be an "off the shelf" item, and the stiffening element fastened to the clamp may be constructed from a number of known sources, such as a commercially available conduit strut clamp.

In operation, the precipitator gets energized with high voltage direct current (DC). As the flue gas flows through fields of the precipitator, the particulate get negatively charged from the high voltage. These charged particles are collected on the positively charged plates, and, over the years of operation, the plates (that may be as long as 48 feet in length) have a tendency of bowing. As noted previously, when a bow occurs, it reduces the clearance between the energized electrode and the plate surface. This reduced clearance affects the performance of charging the particles and the over-all performance of the precipitator.

When installing the clips, the plates are retained in a straight line while at the same time are allowed to move freely (as designed), and the clips do not affect the rapping operation of the removing the particulate from the plates.

Advantageously, multiple clips may be used on a single plate so that very complex forms of bending, warping, twisting, and deformation can be addressed. As many or as few clips needed can be added to adapt to whatever bending problems arise.

Furthermore, the clips are extremely easy to manufacture (a trained technician can manufacture over 100 in a couple of hours), require little in the way of installation (no holes, welding, etc.), and are very inexpensive.

DESCRIPTION OF THE DRAWINGS

FIG. 1 is a top view of a first embodiment of the precipitator plate clip;

FIG. 2 is a side view of the embodiment of the precipitator plate clip shown in FIG. 1;

FIG. 3 is an end view of the embodiment of the precipitator plate clip shown in FIG. 1;

FIG. 4 is a top view of a second embodiment of the precipitator plate clip;

FIG. 5 is a side view of the embodiment of the precipitator plate clip shown in FIG. 4;

FIG. 6 is an end view of the embodiment of the precipitator plate clip shown in FIG. 4;

DETAILED DESCRIPTION OF THE PREFERRED EMBODIMENTS

The descriptions below refer to embodiments of the invention and should not be construed as limiting the invention in any way.

Figures 7, 8:
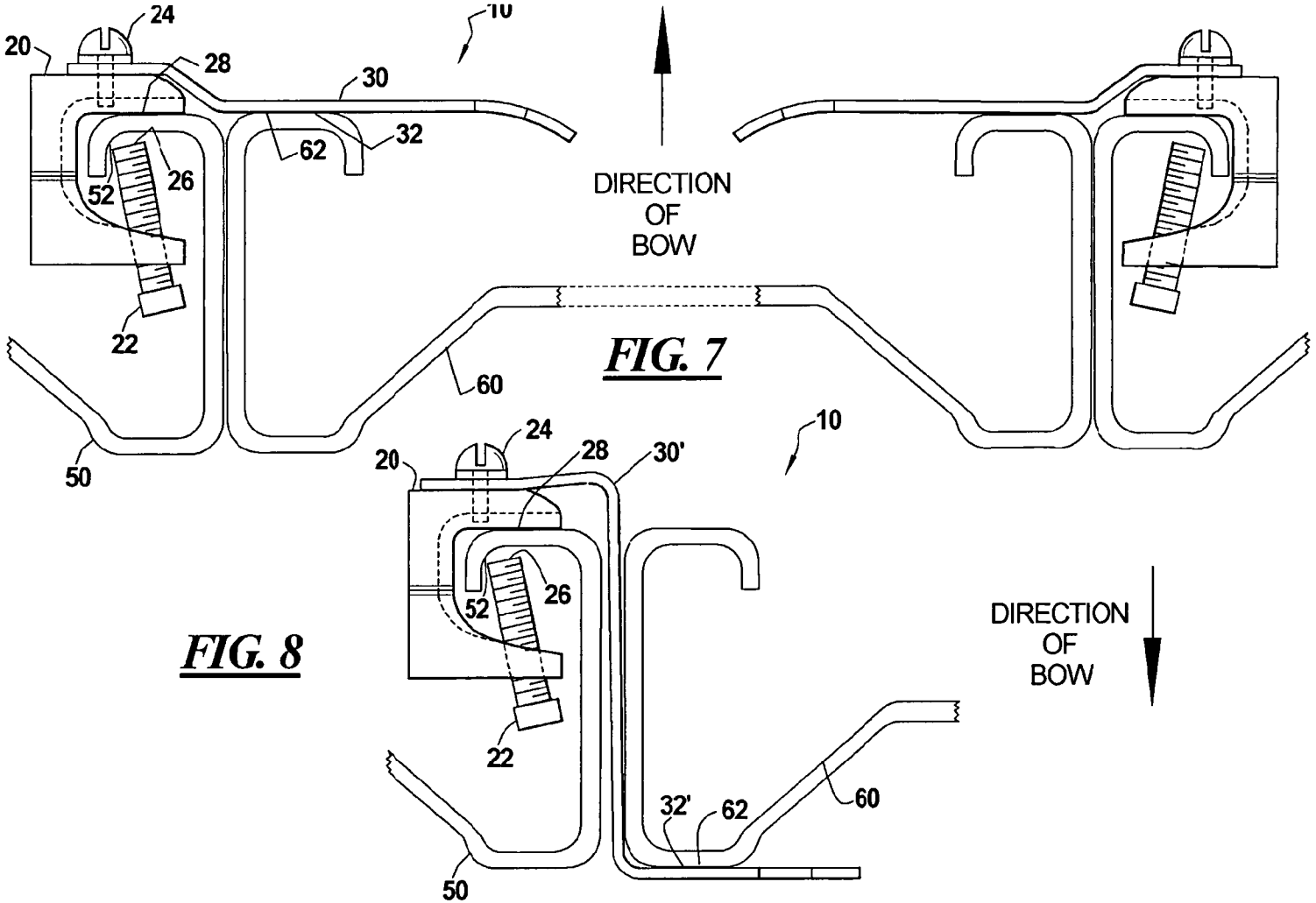
FIG. 7 is a side view of the first embodiment of the precipitator clip holding a first variant of a precipitator plate.
FIG. 8 is a side view of the second embodiment of the precipitator clip holding a first variant of a precipitator plate.

FIGS. 1–3 illustrate a first embodiment of a precipitator collecting plate clip 10 used for straightening or maintaining the straightness of a precipitator collecting plate 60 (FIG. 7); FIG. 1 is a top view, FIG. 2 is a side view, and FIG. 3 is an end view of this embodiment.

According to the embodiment, the clip 10 comprises a beam clamp 20 (generically, a fastening mechanism) that serves to affix the clip 10 to another element. According to this embodiment, the clamp 20 comprises an anchoring bolt 22 that is used to affix the clip 10 by pinning a portion of the other element between an end of the bolt 26 and a beam clamp mating surface 28, as will be described in greater detail below.

The clamp 20 has a spring-like sheet or plate stiffening element 30 connected to it that is made of a material capable of providing at least some force in a direction perpendicular to a plane defined by a primary surface of the stiffening element 30. The stiffening element 30 is affixed to the clamp 20 by, e.g., a fastening screw 24. By providing a spring-like force with the stiffening element 30, the force on the plate 60 is minimized in contrast to the use of a rigid stiffening element, such as a bar, which permits maximum motion for the plate 60 during the rapping operation.

According to the embodiment shown in FIGS. 1–3, the stiffening element 30 is constructed as being generally flat in one dimension, having slight deviations to accommodate the clamp 20 itself and a point of fastening.

Exemplary dimensions of the stiffening element 30 are 4.25" in a maximum length dimension, 1.25" in a width dimension, and approximately 0.1875" in a thickness dimension. One of skill in the art, however, would recognize that other dimensions could easily be used to achieve the same effect. The precise composition and dimensions are not critical to the invention. The stiffening element 30 may be made from sheet or plate stock so that it is inexpensive and simple to construct, and is capable of providing the necessary spring-like force to straighten or prevent from bowing, the plates 60. FIGS. 11–14 illustrate conduit strut clamps whose arms 30, 30' can be directly used as the stiffening elements 30, 30' with some slight bending alterations. Advantageously, these strut clamp arms 30, 30' have an acceptable amount of stiffness in them and already have holes drilled in them, so that further drilling is not necessary.

Similarly, the dimensions of the clamp 20 are not crucial. In the embodiment shown, the clamp may have a height of approximately 1.625" and a width of 1", however, any clamp 20 that could attach to a stiffening element 30 and to an anchor or adjacent precipitating plate 50 could be used.

FIG. 7 illustrates the plate clip 10 being utilized with a fixed anchor 50, which may be rigidly mounted to a frame or may possibly be another adjacent collector plate 60 (the collector plate 60 being shown in an end view such that the view line is parallel with a plane defining the primary surface of the plate 60). As can be seen in FIG. 7, the clamp 20 is affixed to the anchor 50 by sandwiching a portion of the anchor 50 between an end 26 of the bolt 22 and a mating surface 28 of the clamp 20, the bolt end 26 applying sufficient pressure to an anchor bolt surface 52 of the anchor 50 to ensure that the clamp 20 is securely fastened to the anchor 50.

In this embodiment, the bolt may be easily accessed for tightening based on a gap between the anchor/adjacent plate 50 and the bottom of the clamp 20 without requiring any changes to be anchor/adjacent plate 50. Note that the figures are not necessarily drawn precisely to scale.

In this embodiment, a bottom surface of the stiffening element 30 serves as the contacting surface 32 for the plate 60 via its mating surface 62. FIG. 7 illustrates how the presence of the stiffening element 30 serves to impart a force to the collector plate 60 in a direction opposite that of a direction of bow, i.e., the force applied to the collector plate 60 is normal to a primary plane of the plate 60. This force can serve to straighten out a plate 60 that is already bowed, or can prevent a plate 60 from becoming bowed. One or more clips 10 can be utilized along the length of a collector plate 60. The clips 10 provide the necessary force to reduce/prevent bowing while at the same time permit movement of the plate 60 during the rapping operation. Thus, as illustrated in FIG. 7, the stiffening element 30 is designed to contact an outer surface of the plate 60.

The plate clip 10 can be constructed and installed very inexpensively and does not require any significant modification of an existing precipitator system in order to be utilized.

FIGS. 4–6 illustrate a second embodiment of a precipitator collecting plate clip 10 used for straightening or maintaining the straightness of a precipitator collecting plate 60' (FIG. 8); FIG. 4 is a top view, FIG. 6 is a side view, and FIG. 5 is an end view of this embodiment.

According to the second embodiment, the clip 10 comprises a beam clamp 20 similar to that of the first embodiment that serves to affix the clip 10 to another element. According to this embodiment, the clamp 20 comprises an anchoring bolt 22 that is used to affix the clip 10 by pinning a portion of the other element between an end of the bolt 26 and a beam clamp mating surface 28.

The clamp 20 has a spring-like sheet or plate stiffening element 30' connected to it that is made of a material capable of providing at least some force in a direction perpendicular to a plane defined by a primary surface of the stiffening element 30. The stiffening element 30' is affixed to the clamp 20 by, e.g., a fastening screw 24.

According to the embodiment shown in FIGS. 4–6, the stiffening element 30' is constructed as having a z-shaped cross section when viewed edgewise. Ideally, the angles of the z-shape are constructed as close to 90° as possible.

Exemplary dimensions and construction of the stiffening element 30' are similar to those of the previously described for stiffening element 30, with the exception that the overall length could be, e.g., 6.25" before bending. After bending, the two end portions that are parallel may be 2" each, with the central portion at approximately a right angle to the end portions could be approximately 2.25". This dimension must be great enough so that the stiffening portion can accommodate a plate edge width on a plate for which it might be used.

FIG. 8 illustrates the plate clip 10 being utilized with a fixed anchor 50, which may be rigidly mounted to a frame or may possibly be another adjacent collector plate 60 (the collector plate 60 being shown in an end view such that the view line is parallel with a plane defining the primary surface of the plate 60). As can be seen in FIG. 8, the clamp 20 is affixed to the anchor 50 by sandwiching a portion of the anchor 50 between an end 26 of the bolt 22 and a mating surface 28 of the clamp 20, the bolt end 26 applying sufficient pressure to an anchor bolt surface 52 of the anchor 50 to ensure that the clamp 20 is securely fastened to the anchor 50.

In this embodiment, a top surface of the stiffening element 30 serves as the contacting surface 32' for the plate 60 via its mating surface 62. FIG. 8 illustrates how the presence of the stiffening element 30' serves to impart a force to the collector plate 60 in a direction opposite that of a direction of bow, i.e., the force applied to the collector plate 60 is normal to a primary plane of the plate 60. This force can serve to straighten out a plate 60 that is already bowed, or can prevent a plate 60 from becoming bowed. As indicated in the description of the first embodiment, one or more clips 10 can be utilized along the length of a collector plate 60. The clips 10 provide the necessary force to reduce/prevent bowing while at the same time permit movement of the plate 60 during the rapping operation. Thus, as illustrated in FIG. 8, the stiffening element 30' is designed to contact an outer surface of the plate 60.

It should be noted that the use of clips using multiple variants of the stiffening element 30, 30' can be added to a single plate 60 to address a particular type of bowing problem, which may be compound in nature.

Figure 9:
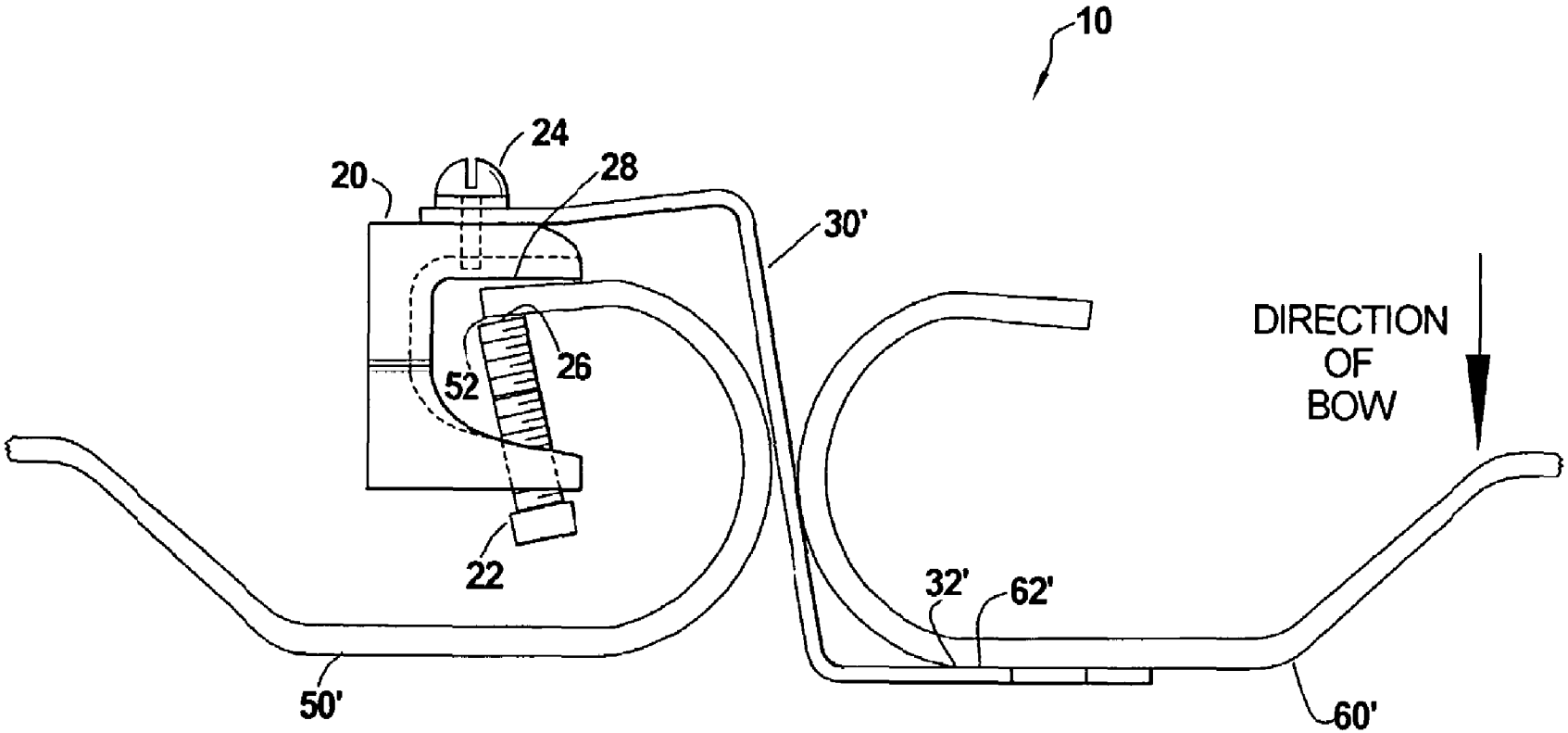
FIG. 9 is a side view of the second embodiment of the precipitator clip holding a second variant of a precipitator plate.
Figure 10:
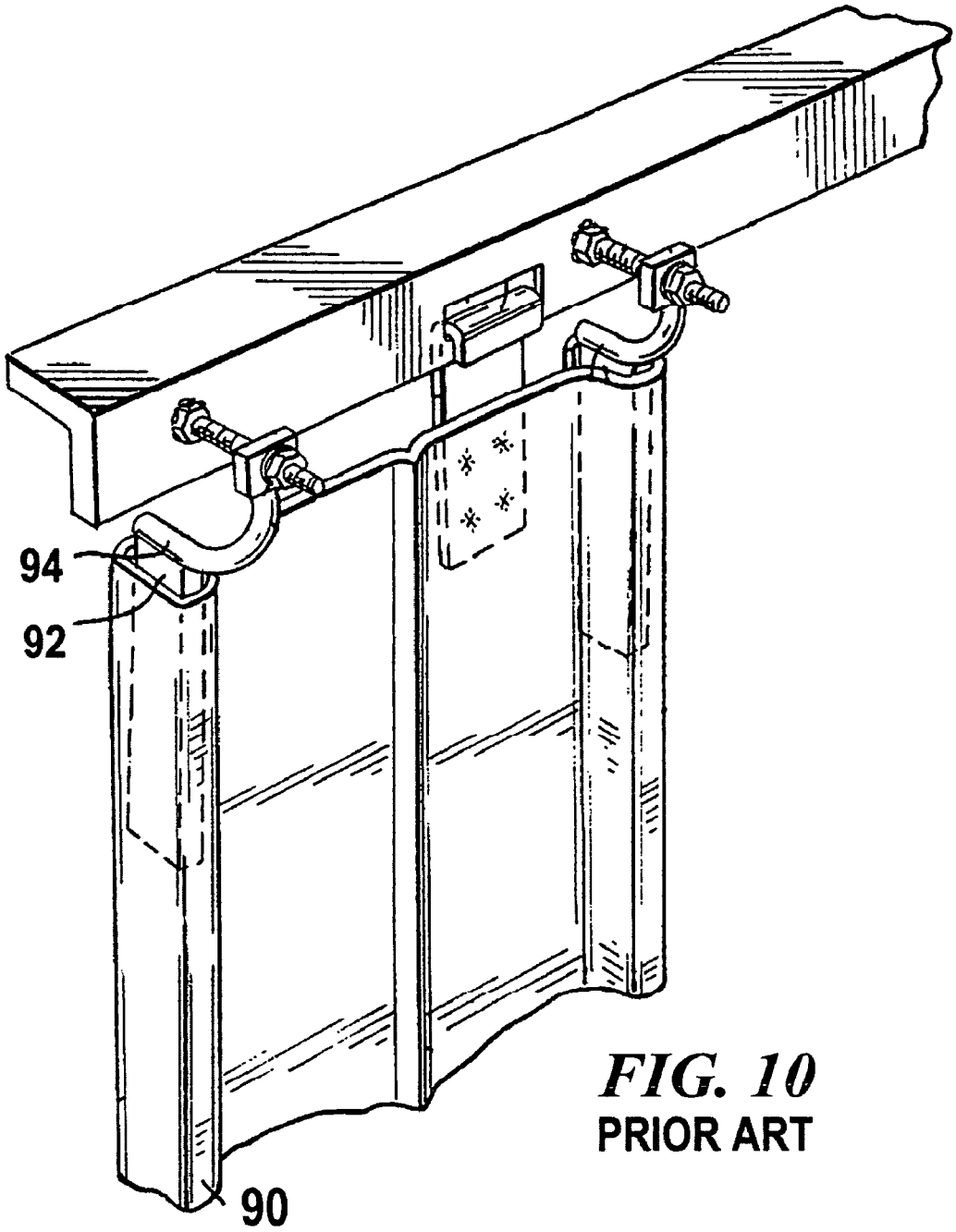
FIG. 10 PRIOR ART
FIG. 10 is an isometric view of a precipitator collector plate with straightening elements according to the prior art.
Figure 11:
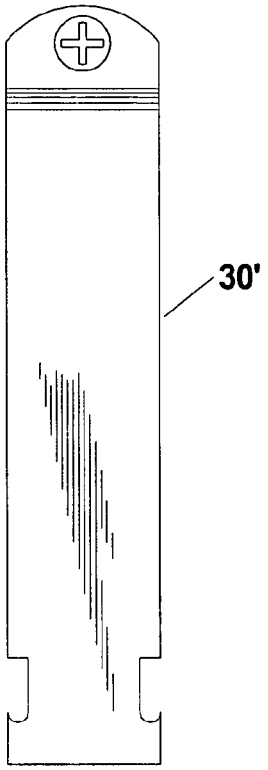
FIG. 11 PRIOR ART
FIG. 11 is a top view of a known conduit strut clamp that can be disassembled so that its constituent parts can be used in the clip.
Figure 12:
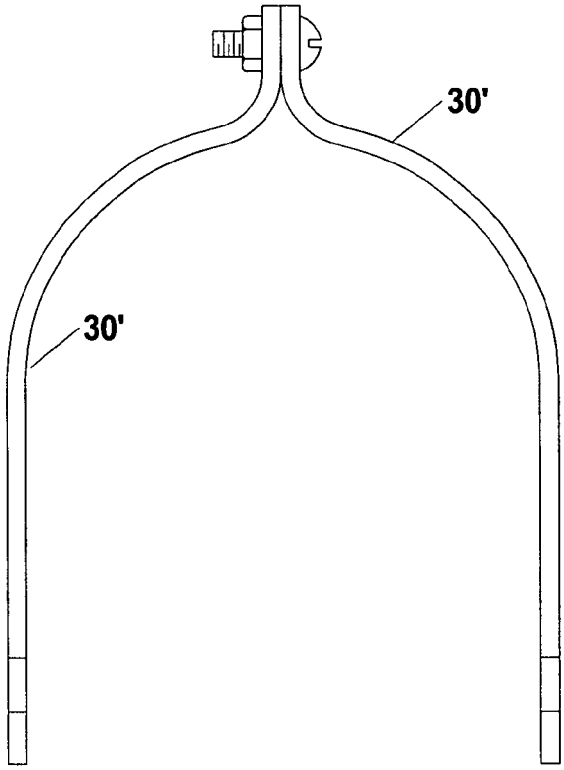
FIG. 12 PRIOR ART
FIG. 12 is a side view of the conduit strut clamp shown in FIG. 11.
Figure 13:
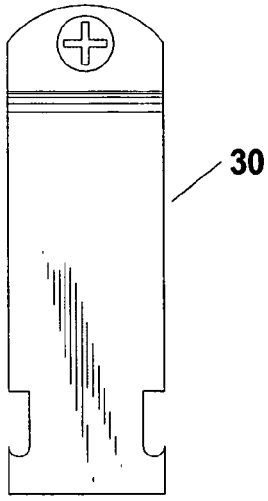
FIG. 13 PRIOR ART
FIG. 13 is a top view of a known conduit strut clamp having shorter members than that shown in FIG. 11.
Figure 14:
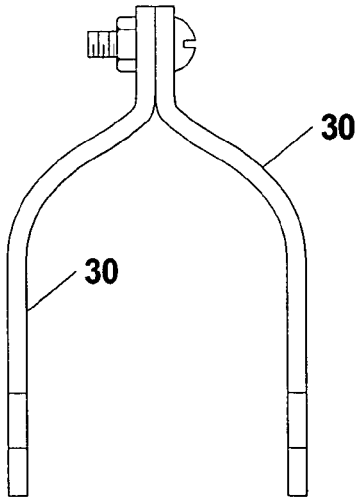
FIG. 14 PRIOR ART
FIG. 14 is a side view of the conduit strut clamp shown in FIG. 13.

FIG. 9 shows an embodiment of the invention utilizing the plate clip illustrated in FIG. 8 where the plate 60' has ends that are shaped differently. This illustrates that the invention is not limited solely to the configurations shown, but can be construed as comprising any variety of shapes have any number of features.

Similar to the first embodiment, the plate clip 10 can be constructed and installed very inexpensively and does not require any significant modification of an existing precipitator system in order to be utilized.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The particular implementations shown and described herein are illustrative examples of the invention and are not intended to otherwise limit the scope of the invention in any way. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE CHARACTERS

| | |
|---|---|
| 10 | precipitator collecting plate clip |
| 20 | beam clamp (fastening mechanism) |
| 22 | anchoring bolt |
| 24 | fastening screw |
| 26 | bolt end |
| 28 | beam clamp mating surface |
| 30, 30' | spring-like sheet or plate stiffening element |
| 32, 32 | stiffening element contacting surface |
| 50, 50' | fixed anchor or possibly another anchoring collector plate |
| 52 | anchor bolt surface |
| 60, 60' | precipitator collecting plate |
| 62, 62' | precipitator plate mating surface |

What is claimed is:

1. A method for preventing bowing of a precipitator collecting plate, comprising:

attaching a spring-like stiffening element to a fastening mechanism;

fastening the fastening mechanism to at least one of a fixed anchor and an adjacent anchoring collector plate; and contacting the stiffening element with the precipitator collecting plate, thereby applying a spring-like force in a direction normal to a primary plane, which is generally co-linear but opposite in direction of a direction of bowing, of the precipitator collecting plate.

2. The method according to claim 1, wherein the contacting of the stiffening element with the precipitator collecting plate occurs on an outer surface of a curved edge portion of the collecting plate.

3. The method according to claim 1, wherein a contacting surface of the stiffening element with a mating surface of the plate resides in a plane located on a same general end of the fastening mechanism as a point at which the stiffening element is attached to the fastening mechanism.

4. The method according to claim 3, wherein the stiffening element has a smallest dimension in the direction of bowing.

5. The method according to claim 1, wherein a contacting surface of the stiffening element with a mating surface of the plate resides in a plane located on an opposite general end of the fastening mechanism as a point at which the stiffening element is attached to the fastening mechanism.

6. The method according to claim 5, wherein the stiffening element has a generally z-shape in a cross-section when viewed parallel to a plane parallel to a primary surface of the plate.

7. The method according to claim 1, wherein the fastening mechanism is a clamp.

8. The method according to claim 1, further comprising rapping the collecting plate, wherein the collecting plate has at least one degree of freedom of movement with respect to the stiffening element.

9. A bow-reduced precipitator collector plate assembly, comprising:

a precipitator collector plate having a mating surface;

a fastening mechanism configured to be attached to at least one of a fixed anchor and an adjacent anchoring collector plate, the fastening mechanism comprising:

a spring-like stiffening element attached to the fastening mechanism at an attachment point, the stiffening element having a contacting surface in contact with the plate mating surface, the stiffening element configured to apply a force in a direction normal to a primary plane, which is generally co-linear but opposite in direction of a direction of bowing, of the precipitator collecting plate.

10. The assembly according to claim 9, wherein collecting plate comprises a curved edge portion, and the contacting of the stiffening element with the precipitator collecting plate occurs on an outer surface of the curved edge portion of the collecting plate.

11. The assembly according to claim 9, wherein the contacting surface of the stiffening element with the mating surface of the plate resides in a plane located on a same general end of the fastening mechanism as a point at which the stiffening element is attached to the fastening mechanism.

12. The assembly according to claim 9, wherein the stiffening element has a smallest dimension in the direction of bowing.

13. The assembly according to claim 9, wherein the contacting surface of the stiffening element with a mating surface of the plate resides in a plane located on an opposite general end of the fastening mechanism as a point at which the stiffening element is attached to the fastening mechanism.

14. The assembly according to claim 9, wherein the stiffening element has a generally z-shape in a cross-section when viewed parallel to a plane parallel to a primary surface of the plate.

15. The assembly according to claim 9, wherein the fastening mechanism is a clamp.

16. The assembly according to claim 9, wherein the stiffening element is formed from sheet metal or thin plate stock.

* * * * *